US006222502B1

(12) United States Patent
Falbo et al.

(10) Patent No.: US 6,222,502 B1
(45) Date of Patent: Apr. 24, 2001

(54) ANTENNA MOUNTING ENCLOSURE

(75) Inventors: Richard R. Falbo, Inverness; Joseph F. Kelter, Wonder Lake; John A. Kise, Woodstock, all of IL (US)

(73) Assignee: Switzer Products, L.L.C., Richmond, IL (US)

( * ) Notice: Subject to any disclaimer, the term of this patent is extended or adjusted under 35 U.S.C. 154(b) by 0 days.

(21) Appl. No.: 09/067,796

(22) Filed: Apr. 28, 1998

(51) Int. Cl.[7] ..... H01Q 21/00
(52) U.S. Cl. ..... 343/879; 343/878
(58) Field of Search ..... 343/874, 875, 343/878, 879, 890, 892; H01Q 21/00

(56) References Cited

U.S. PATENT DOCUMENTS

| | | | | |
|---|---|---|---|---|
| 1,419,241 | | 6/1922 | Edwards . | |
| 2,037,895 | | 4/1936 | Gugler . | |
| 3,214,755 | * | 10/1965 | Blass et al. | 343/874 |
| 3,694,974 | | 10/1972 | Eckel | 52/36 |
| 3,768,016 | * | 10/1973 | Townsend et al. | 343/874 |
| 4,478,467 | | 10/1984 | Tyndall | 312/250 |
| 4,571,898 | | 2/1986 | LeCacheux et al. | 52/36 |
| 4,733,507 | | 3/1988 | Doublet | 52/63 |
| 5,036,634 | | 8/1991 | Lessard et al. | 52/79.1 |
| 5,282,341 | | 2/1994 | Baloga et al. | 52/32 |
| 5,291,211 | * | 3/1994 | Tropper | 343/890 |
| 5,315,794 | | 5/1994 | Pearson | 52/79.1 |
| 5,500,962 | | 3/1996 | Tagg | 4/476 |
| 5,537,787 | | 7/1996 | Abraham | 52/79.1 |
| 5,581,958 | * | 12/1996 | Cote | 343/890 |
| 5,619,217 | | 4/1997 | Mailandt et al. | 343/872 |
| 5,653,063 | | 8/1997 | Barnett et al. | 52/29 |
| 5,654,722 | * | 8/1997 | Lundback et al. | 343/890 |
| 5,872,548 | * | 2/1999 | Lopez | 343/892 |

* cited by examiner

*Primary Examiner*—Don Wong
*Assistant Examiner*—Hoang Nguyen
(74) *Attorney, Agent, or Firm*—Brinks Hofer Gilson & Lione

(57) ABSTRACT

An apparatus for mounting antennas is disclosed herein. The apparatus includes an enclosure having at least three adjoining side walls defining an interior space. Each of the walls includes an exterior surface and means on the exterior surfaces for mounting a plurality of antennas to the walls. The enclosure defines at least one opening to allow access to said interior space. The antennas may thus be mounted to the enclosure to be pointed in at least three opposing directions approximately 120 degrees apart, while the interior space and exterior walls of the enclosure provides a convenient and substantially weatherproof area to store support equipment for operation of the antennas.

7 Claims, 1 Drawing Sheet

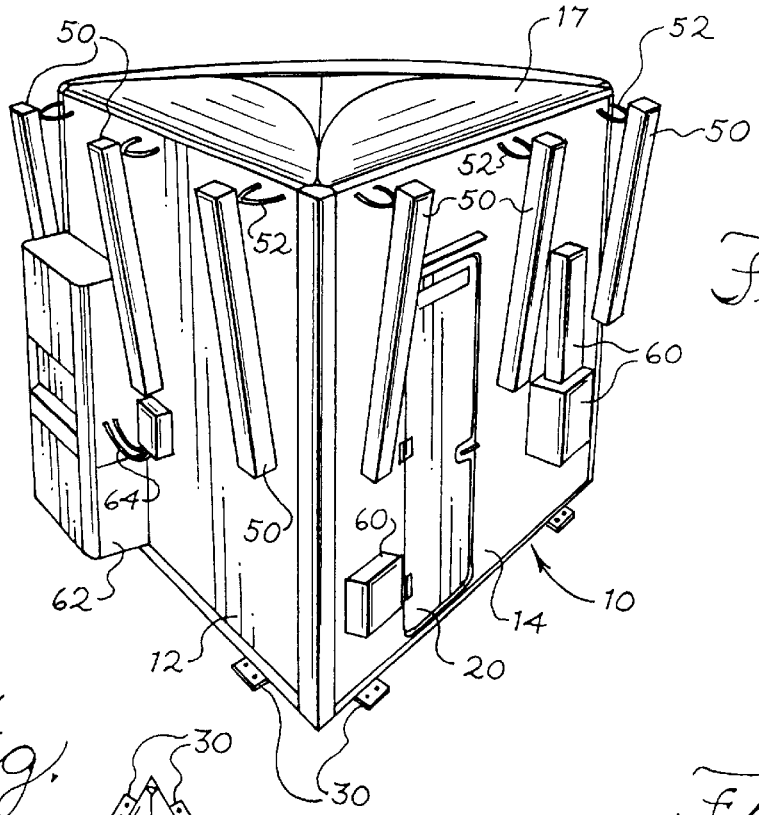
Fig. 4
Fig. 3
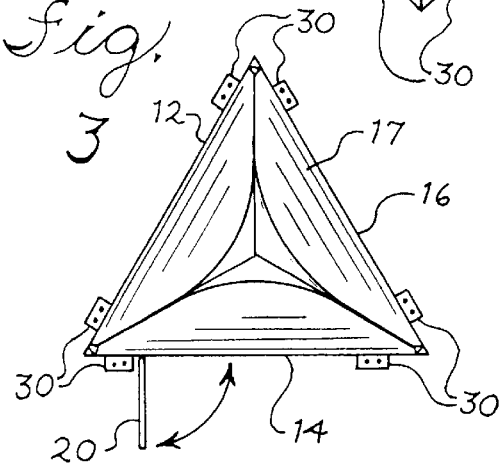
Fig. 1
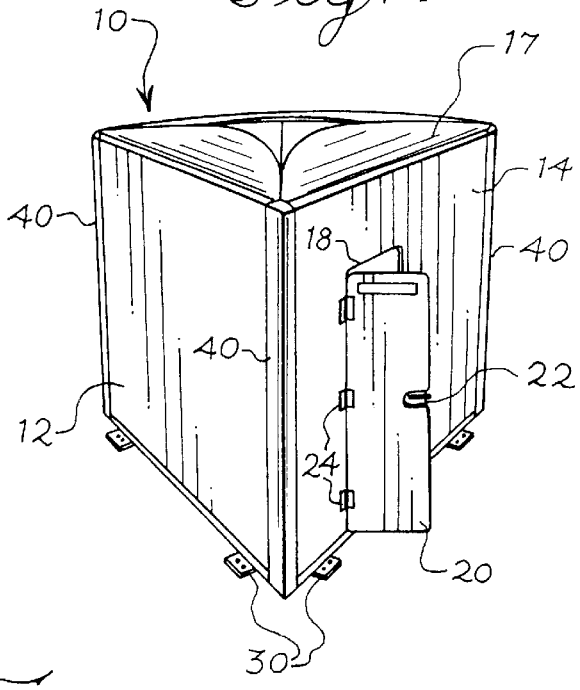
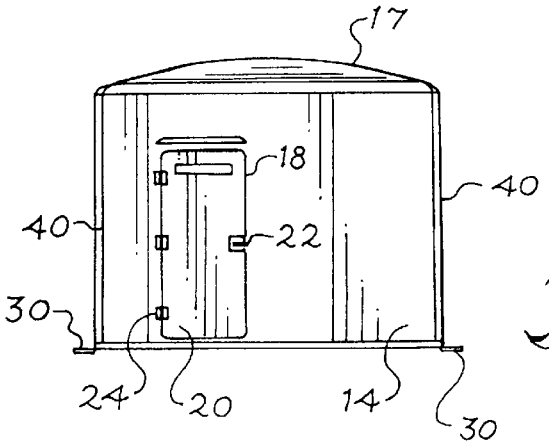
Fig. 2

ANTENNA MOUNTING ENCLOSURE

BACKGROUND OF THE INVENTION

This invention relates to directional antennas and radio communications, and more particularly to an apparatus for mounting directional antennas.

Wireless telecommunications systems utilize radio signals to exchange information between fixed-wire base stations and free-standing mobile stations. In cellular communications applications, for example, each base station transmits from an antenna over a fixed-area range called a "cell." In order to provide service to mobile telephones over a large geographic area, many cells are positioned over the area to provide complete coverage.

In typical cellular configurations, base station antennas create large, hexagonal or circular-shaped macrocells with the main antennas located at the center of the cell. The transmissions from the base station ideally propagate outward 360 degrees from the antennas. These cells are often referred to as "omni-directional." These omni-directional cells require the base station antennas to be mounted in an array that allows them to be pointed in a plurality of directions to provide 360 degrees of coverage. In order to provide this wide range of unobstructed coverage, the antennas must be mounted in a clear area, often located high above the ground on antenna towers.

In most cellular applications in densely occupied urban areas, the cellular antennas are mounted more closely to street level on towers projecting from the rooftops of buildings. These towers have proven to be unsightly, especially where the towers mount several antennas and their associated circuitry, cabling and other necessary equipment within the plain view of persons on the ground. The unsightliness of these structures can result in the unwillingness of building owners to allow necessary cellular antennas to be installed on their buildings.

Therefore, there is a need for an improved apparatus for mounting directional antennas and related equipment in a fashion that allows omni-directional propagation while maintaining a pleasant appearance.

SUMMARY OF THE INVENTION

The present invention provides an apparatus for mounting a plurality of antennas via a convenient, visibly pleasing, self-contained structure. The present invention may be embodied in an apparatus that includes an enclosure having three adjoining side walls defining an interior space. Each of the walls includes an exterior surface and means on the exterior surfaces for mounting a plurality of antennas to the walls. The enclosure defines at least one opening to allow access to the interior space. The antennas may thus be mounted to the enclosure to be pointed in at least three opposing directions approximately 120° apart to provide 360°, omni-directional coverage. The interior space of the enclosure provides a convenient weatherproof area to store support equipment for operation of the antennas.

In another aspect of the invention, each of the three main side walls of the enclosure are positioned approximately 120° to each other, thereby creating a structure having a horizontal cross-section corresponding to an equilateral triangle. The upstanding walls allow sets of antennas to be mounted along each wall and pointed in a direction generally perpendicular to the plane of each wall. This allows a 360° range of coverage for the antennas arrayed on the apparatus.

In another aspect of the invention, the apparatus is adapted for positioning on a rooftop in an unobtrusive fashion. The upstanding walls of the structure allow for camouflaging and provide a convenient enclosed space for enclosing and mounting electronic support equipment and cables out of sight.

The present invention may be further embodied in an apparatus that includes mounting means to allow antennas to be mounted to the enclosure along at least three planes angled approximately 120 degrees to each other. This structure allows antennas to be mounted to an enclosure having a variety of shapes.

Thus, the present invention provides a convenient apparatus for inconspicuously mounting directional antennas. The present invention may be used to mount antennas such as directional cellular antennas to the rooftops of buildings or other vertical structures, while providing an area for storage and mounting of related support equipment within the apparatus.

It is to be understood that both the foregoing general description and the following detailed description are exemplary and explanatory and are intended to provide further explanation of the invention as claimed. The invention, together with further objects and attendant advantages, will best be understood by reference to the following detailed description, taken in conjunction with the accompanying drawings.

BRIEF DESCRIPTION OF THE DRAWINGS

FIG. 1 shows a perspective view of the preferred embodiment of the present invention.

FIG. 2 shows an enlarged side view of the preferred embodiment of the invention of FIG. 1.

FIG. 3 shows a top view of the preferred embodiment of the invention of FIG. 1.

FIG. 4 shows a perspective view of the preferred embodiment of FIGS. 1 and 2 including mounted antennas and related hardware.

DETAILED DESCRIPTION OF THE PREFERRED EMBODIMENT

FIG. 1 illustrates a perspective view of the preferred embodiment of the enclosure apparatus 10. Taken in conjunction with the side and top views shown at FIGS. 2 and 3, the enclosure 10 includes upstanding side walls 12, 14 and 16. Preferably, each of the walls 12, 14 and 16 meets with an adjacent wall at an angle of approximately 120°, thereby forming an enclosure having cross-section similar to an equilateral triangle. A unitary, triangular roof structure 17 having a slightly domed configuration is mounted over the walls 12, 14 and 16.

In the preferred embodiment, side wall 14 defines an opening or doorway 18 to allow passage into the interior of the enclosure 10. Doorway 18 may be sealably closed by a door 20 mounted to the wall 14 by hinges 24. Preferably, the door is tall enough for a person to comfortably pass through. The door 20 also preferably includes a latch 22 of conventional design.

In the preferred embodiment, a fiberglass, molded composite laminate is used to form the walls 12, 14 and 16 of the enclosure 10. Preferably, the composite material is approximately 1½ inches thick. The interior of the walls also preferably are covered with ¾-inch polyurethane insulating foam sheeting. The floor of the enclosure 10 preferably comprises an 18-gauge steel sheeting base and a cover layer of ¾-inch plywood. This material is weatherproof and lightweight, yet strong enough to support the mounting of heavy antenna hardware. Additional stability at the joints between walls 12, 14 and 16 may be added by mounting reinforced corner braces 40. The exterior dimensions of the preferred embodiment of the enclosure 10 are preferably 12 feet wide for each of walls 12, 14 and 16, and 11 feet in height. In the alternative, the walls 12, 14 and 16, the door 20, and roof 17 preferably may also be constructed from sheet metal approximately 18-gauge.

The enclosure 10 may be mounted to rooftop surfaces via mounting brackets 30. The brackets 30 can receive mounting bolts (not shown) to hold the brackets 30 and the enclosure 10 flush to the rooftop surface.

A possible configuration of the enclosure 10 incorporating antenna hardware and related equipment is illustrated in FIG. 4. As shown in the figure, three directional cellular antennas 50 are mounted on each of the side walls 12, 14 and 16 via mounting brackets 52. The brackets 52 can be of a structure known to those skilled in the art as sufficient to mount various forms of antennas. Each of the antennas 50 are positioned in this embodiment to be pointing slightly downwardly as shown. This configuration provides improved cellular range on the ground when the enclosure 10 is mounted to a high surface such as a rooftop.

Miscellaneous hardware, such as the power boxes 60 and electrical switchboxes 62, may be mounted to the walls 12, 14 and/or 16 of the enclosure 10 as shown in FIG. 4. The walls may be drilled and grommetted to provide weatherproof passage means as shown for cables 64 to link the exterior surfaces of the walls 12, 14 and 16 with the interior of the enclosure 10. Other electrical or antennas support equipment may be stored inside the enclosure 10 to shield the equipment from weather.

The preferred embodiment provides 360° of coverage for cellular antennas with the 120° angled wall configuration shown. However, other configurations may be appropriate while remaining within the scope of the invention. For example, the walls 12, 14 and 16 may not necessarily define an equilateral triangle, but may define an irregular triangular structure to more attractively blend in with architecture or surroundings of a particular rooftop. The three angled main walls 12, 14 and 16 will still provide a wide range of coverage. Furthermore, variously shaped mounting brackets may be utilized to mount the antennas 50 to the structure so that the antennas 50 mounted in an array on the enclosure 10 may be pointing in various directions to provide 360° of coverage. In the alternative, the three main walls 12, 14 and 16 may be separated by other spacing walls rather than meeting at the corners to produce a triangle. Thus, a triangular structure such as in the preferred embodiment is not necessary to provide 360° of coverage, and various shapes may be utilized.

The enclosure of the present invention advantageously provides a secure, stable and convenient structure on which to mount antennas and related equipment. The structure also encloses and hides unsightly equipment and may be further camouflaged with paint or other materials to make a more attractive enclosure. Furthermore, the contained structure of the enclosure can be easily pre-manufactured off-site and pre-fitted with the antennas. This greatly simplifies installation on building locations.

Of course, it should be understood that a wide range of changes and modifications can be made to the preferred embodiments described above. For example, the enclosure described herein should not be limited to the precise structure and orientation shown in the drawings and described in the specification. It is therefore intended that the foregoing detailed description be regarded as illustrative rather than limiting and that it be understood that it is the following claims, including all equivalents, which are intended to define the scope of this invention.

What is claimed is:

1. An apparatus for containing and mounting antenna equipment, said apparatus comprising:

an enclosure having at least three adjoining side walls defining an interior space, each of said walls having a pre-fabricated exterior surface, wherein said interior space is substantially waterproof;

means on the exterior surface of each of said walls for mounting a plurality of antennas;

at least one opening defined in one of said walls to allow access to said interior space, wherein said at least one opening further comprises a doorway and a door hingeably mounted therein; and a plurality of antennas mounted to said walls.

2. The apparatus of claim 1 further comprising a plurality of sealable conduits between said interior space and said exterior surfaces of said walls to allow wiring to pass between said interior space and said antennas.

3. The apparatus of claim 2 further comprising a triangular roof mounted over said side walls.

4. An apparatus for containing and mounting antenna equipment, said apparatus comprising:

an enclosure having at least three adjoining side walls defining an interior space, each of said walls having a pre-fabricated exterior surface;

means on the exterior surface of each of said walls for mounting a plurality of antennas;

at least one opening defined in one of said walls to allow access to said interior space; and mounting means for securing said enclosure to a rooftop position.

5. An apparatus for mounting antennas said apparatus comprising:

an enclosure having means for mounting a plurality of antennas along a plurality of separate planes angled approximately 120 degrees from each other, said enclosure defining an interior space, wherein said means for mounting a plurality of antennas comprises at least three side walls defining said enclosure and being positioned 120 degrees from each other;

at least one access opening defined in said enclosure to allow passage to said interior space; and three spacing walls each mounted between each of said side walls.

6. An apparatus for mounting antennas said apparatus comprising:

an enclosure having means for mounting a plurality of antennas along a plurality of separate planes angled approximately 120 degrees from each other said enclosure defining an interior space wherein said means for mounting a plurality of antennas allow said antennas to be pointed outwardly from said enclosure in a direction substantially perpendicular to each of said planes; and at least one access opening defined in said enclosure to allow passage to said interior space, wherein said access opening is covered by a door hingeably mounted to said enclosure.

7. The apparatus of claim 6 wherein said interior space is substantially sheltered from weather.

* * * * *